United States Patent [19]

Hammarqvist

[11] 4,081,089

[45] Mar. 28, 1978

[54] ARRANGEMENT FOR HANDLING AND PREPARATION OF BASE PLATES AND THE LIKE SUCH AS, FOR EXAMPLE, CASTING MOLDS

[75] Inventor: Bo Georg Hammarqvist, Norberg, Sweden

[73] Assignee: AB Norbergs Mekaniska Verkstad, Norberg, Sweden

[21] Appl. No.: 690,517

[22] Filed: May 27, 1976

[30] Foreign Application Priority Data

May 30, 1975 Sweden ..... 7506210

[51] Int. Cl.[2] ..... B65G 67/02

[52] U.S. Cl. ..... 214/38 CC

[58] Field of Search ..... 214/38 CC, 38 CA, 38 CB, 214/512, 16.4 A, 16.4 B, 301, 302, 310, 309; 104/48, 88, 162

[56] References Cited

U.S. PATENT DOCUMENTS

| | | | |
|---|---|---|---|
| 1,013,826 | 1/1912 | Stegeman | 214/38 CC |
| 3,182,823 | 5/1965 | Chasar | 214/38 CC |

*Primary Examiner*—Evon C. Blunk
*Assistant Examiner*—Lawrence E. Williams
*Attorney, Agent, or Firm*—Finnegan, Henderson, Farabow & Garrett

[57] ABSTRACT

The invention relates to an arrangement for handling and preparation of base plates and the like such as, for example, casting molds, especially after and before casting, in which the arrangement comprises at least two cooperating, crossing transport lines. Each transport line consists of a fixed bed for supporting the base plates or casting molds and there is at least one transport car in each transport line, the transport car being provided with raisable and lowerable means arranged to carry the base plates as they are transported along the transport line and from one transport line to the other.

9 Claims, 7 Drawing Figures

Figure 1:
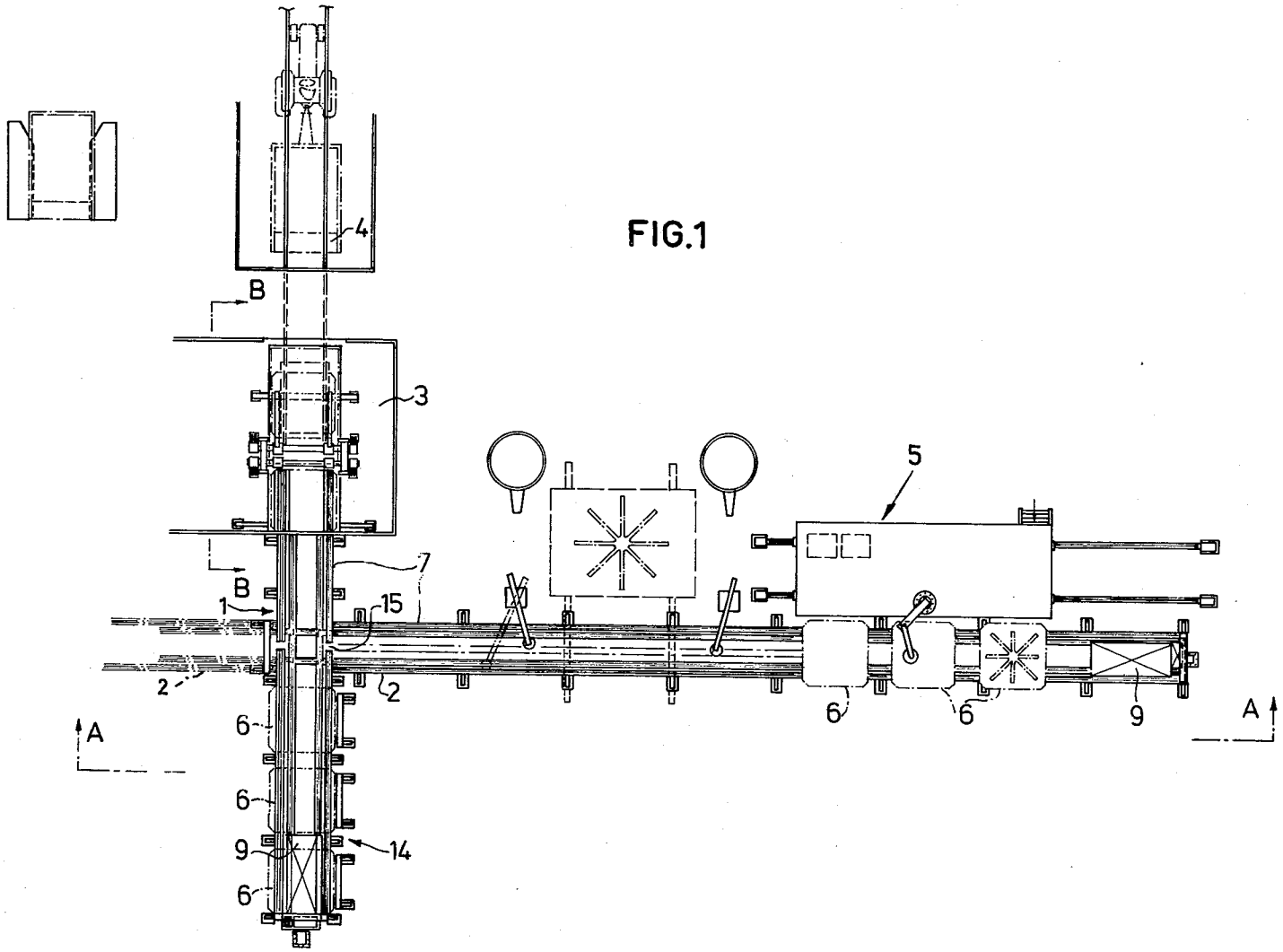

ARRANGEMENT FOR HANDLING AND PREPARATION OF BASE PLATES AND THE LIKE SUCH AS, FOR EXAMPLE, CASTING MOLDS

In steel mills and foundries the handling of heavy equipment such as, for example, casing molds and base plates, with or without ingot molds, and their preparation is a time consuming and often difficult task. Ways of facilitating this work are quite welcome.

Up to now the base plates with the ingot molds have been handled with the help of overhead cranes running on crane tracks with one or more assistants on the work floor in addition to the operator of the overhead crane. Personnel requirements are thus relatively large and furthermore the assistants on the work floor are subjected to risks since they have to help the operator, with hooks and rabbles and other simple tools, to turn the ingot molds or the base plates and help the crane operator get the respective parts in the desired positions. This is true for both knocking out and preparation of, for example, base plates.

In bottom casting the base plates must be cleaned of scrap and used runner bricks after teeming and must be prepared for reuse with new bricks in the runners of the base plate, as well as a new ingate.

The same also applies of course to casting molds and large ingot molds, for example, where a reduction of the time that the crane or cranes are tied up with handling the same would be especially welcome.

If it is also possible to reduce the health hazards to the personnel involved with this handling, this of course should also be strived for.

Since the handling of ingot molds and base plates necessarily makes up a large portion of the work in bottom casting in the casting bay and the teeming station, the advantages were discovered early of arranging separate stations for different types of work, e.g. a teeming station, a knocking out station (stripping station), a preparation station, and so on. This is known.

However transportation between the various stations has caused problems and demanded a great amount of work.

The present invention proposes a solution to the transportation problem between the various stations, whereby the labor requirements are reduced and the danger of hanging loads and the like is removed. Furthermore health hazards in the form of dust and such can be easily removed.

The invention relates to an arrangement for the handling and preparation of base plates and the like such as, for example, casting molds, especially before and after casting, in which the arrangement comprises at least two cooperating transport lines crossing each other. The distinguishing feature of the invention is that each transport line consists of a fixed bed for supporting the base plates or casting molds and that there is at least one transport car in each transport line, the transport car being provided with raisable and lowerable means arranged to carry the base plates as they are transported along the transport line and from one transport line to the other.

In one embodiment of the invention the arrangement comprises two transport lines, in which at least one knocking out station with turning means for the base plates or casting molds is arranged in one transport line, and at least one preparation station is arranged in the other transport line.

According to the invention the fixed bed consists of two rows of columns, the columns in each row being connected at the top by rails or beams. The base plates or casting molds rest on top of the rails or beams.

The transport car included in the arrangement according to the invention consists of a wheeled chassis with a driving motor, means of energy supply, and a lifting device, which can be raised and lowered, mounted on said chassis, for the base plates or casting molds. The transport car of each line is movable on a track disposed between the rows of columns.

In a suitable embodiment the transport car as well as its lifting means are hydraulically driven.

Figure 2:
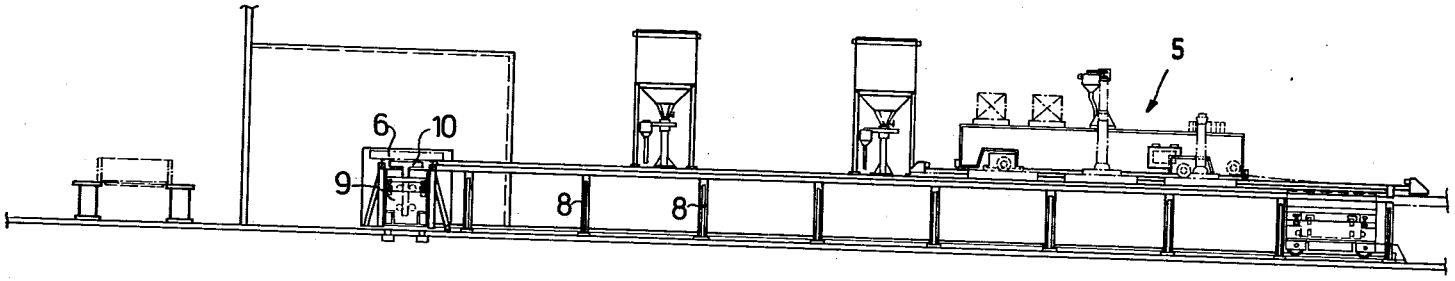
Figure 3:
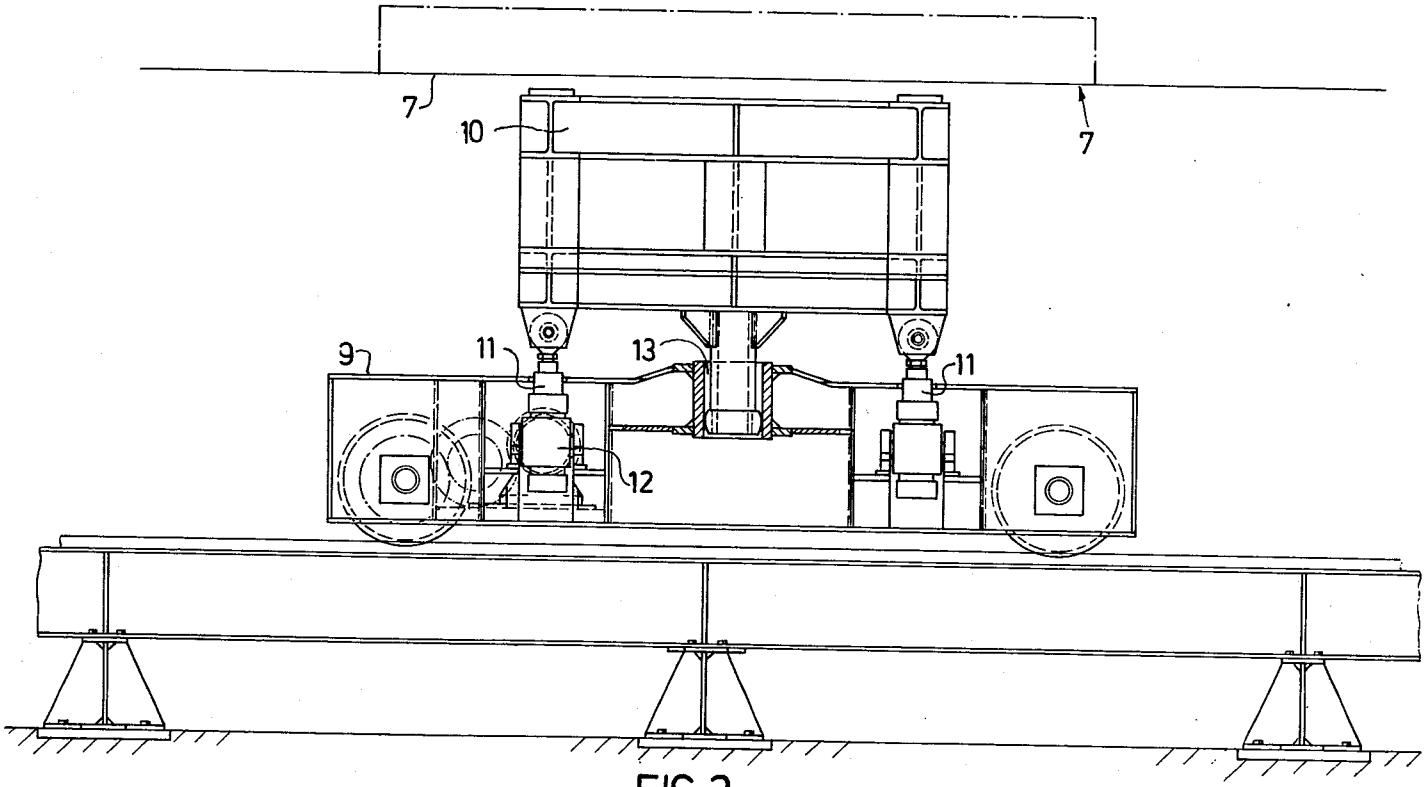
Figure 4:
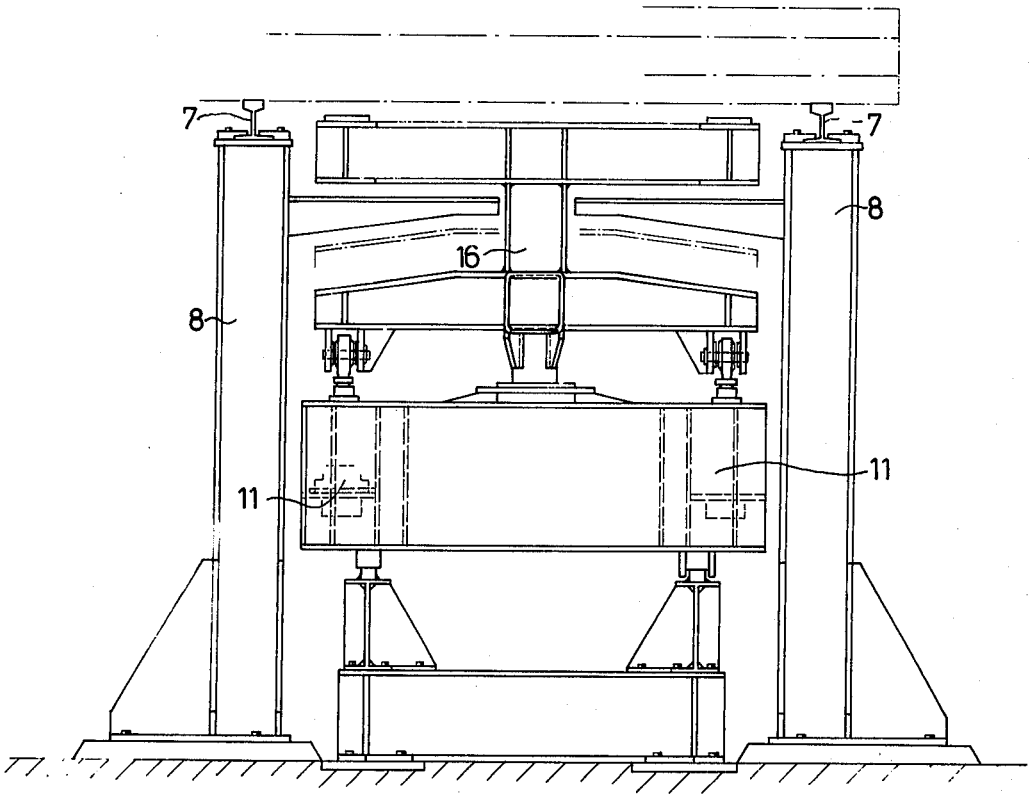
Figure 5:
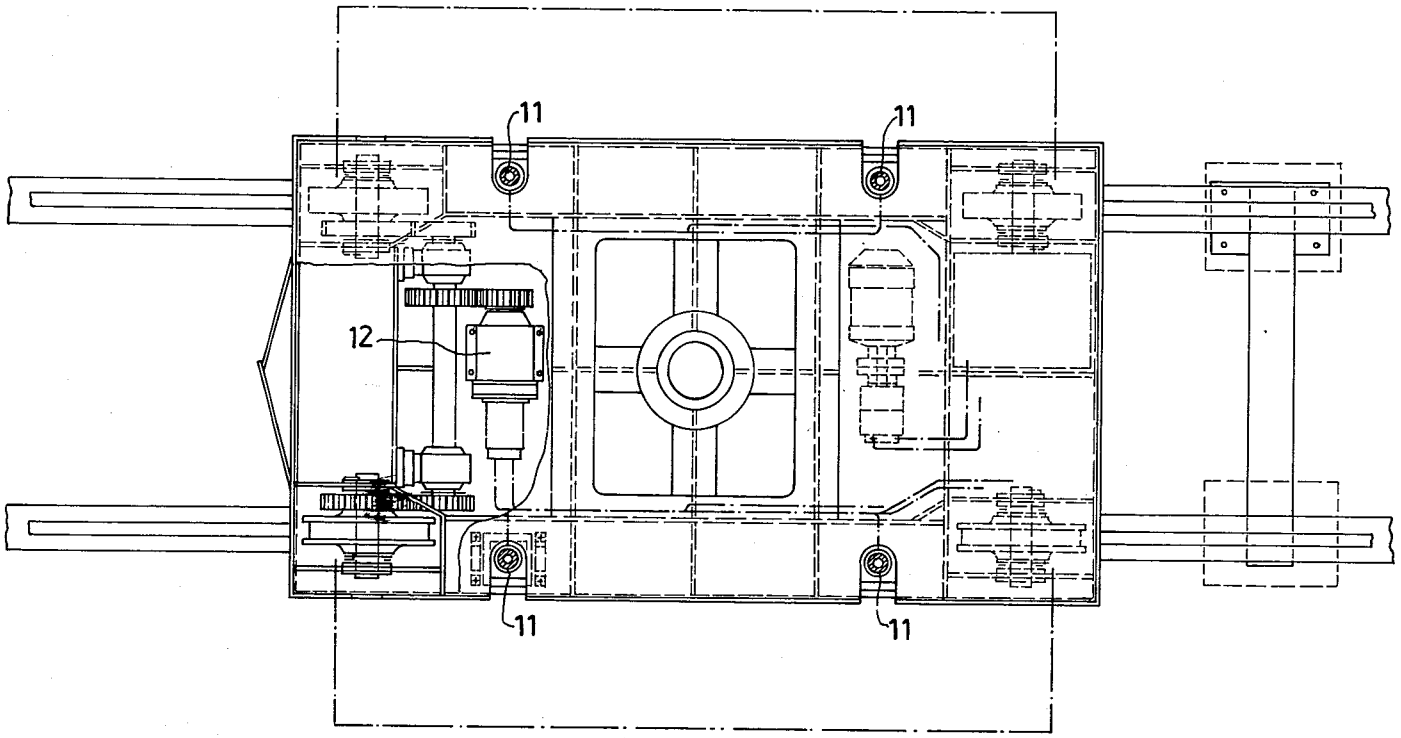
Figures 6, 6A:
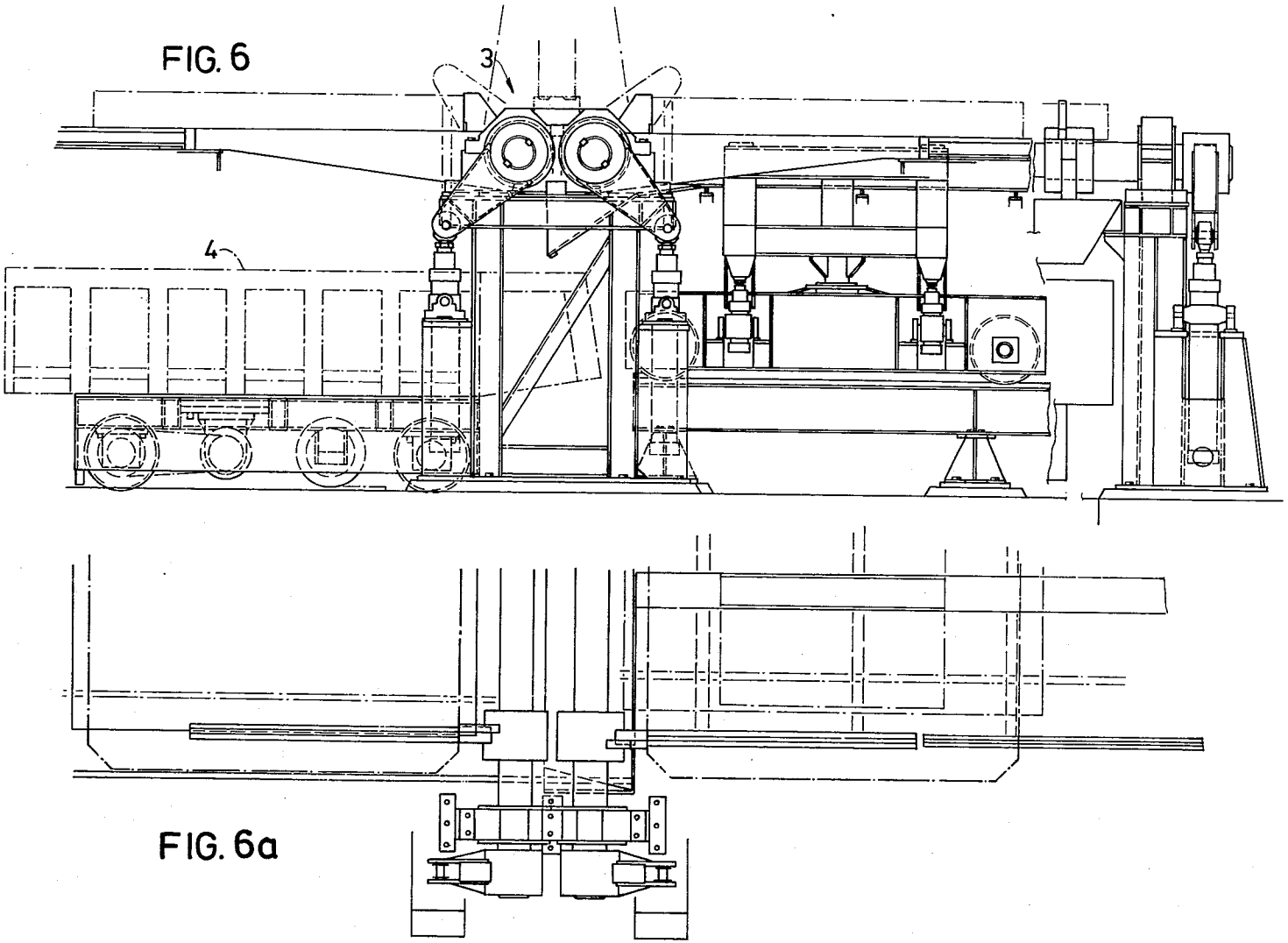

The invention will be explained in more detail in connection with the accompanying drawings in which FIG. 1 shows a conceived embodiment viewed on a plane of the arrangement according to the invention, FIG. 2 shows a side projection of the same arrangement as FIG. 1, FIG. 3 shows a side view of the transport car, FIG. 4 shows an end view of the same transport car as FIG. 3, FIG. 5 shows a horizontal view of a section of the transport car, FIG. 6 shows the transport car with the turning device for base plates, and FIG. 6*a* shows a cut-away part of the turning device as seen from above, said turning device not being claimed inventive.

An arrangement for handling of base plates is shown in the drawings in which FIG. 1 shows two transport lines 1 and 2 arranged essentially at right angles to one another. Transport line 1 contains a known turning device 3 for the base plates, in which the base plates are turned over, knocked out and subsequently cleaned. Used material falls down into a removable scrap container.

Transport line 2 contains a preparation station 5 where the base plates after cleaning are prepared anew.

The base plates rest on a fixed bed which consists of rails 7, which are supported by columns 8 in two rows between which, in the present embodiment, a transport car travels in each transport line. These transport cars 9 move on tracks between the columns 8.

The transport car is provided with a lifting device 10 which can be raised and lowered, which in the present example is controlled by four hydraulic cylinders 11. Furthermore the car is provided with a drive means which can be a hydraulic motor, which is supplied by a car-mounted, electrically driven hydraulic unit, which is in turn powered via a trailing electric cable. The lifting device 10, which can be raised and lowered, is also provided with central guiding means 13 disposed in the chassis of the car.

The arrangment according to the invention functions in the following manner:

With the help of an overhead crane the base plates are transported to the transport line 1 and are placed in the turning device 3 for knocking out and subsequent cleaning. After turning the base plate is checked to see if it is clean and if this is not the case it is turned over again or chipped clean, if necessary, of any leaked metal that may have leaked through the joints between the runner bricks during the teeming operation. When the base plate is clean the transport car 9 of line 1 is caused to come and pick up the base plate and transport it by moving it in under the base plate and to lift the base plate by means of its lifting device 10 which carries the base plate somewhat above the rails 7 of the fixed bed, to the desired location, either to an intermediate position 14 for cleaned base plates or to a position right in front of transport line 2. The lifting device is operated so that the base plate is lowered down onto the fixed bed and the transport car from line 2 is driven under the base plate 6 in question after the car of the first line has been moved away. The lifting device 10 of this transport car is raised so that the base plate is raised above the fixed bed. However, to enable the car to move to the preparation station with the base plate lifted above the fixed bed, the fixed bed of line 1, in the example, must be provided with an opening 15 in the fixed rail 7 of the bed so as to allow the lifting column 16 of the lifting device 10 to pass.

Along line 2 the various tasks required to re-prepare the base plate for the next teeming operation, eg filling with sand, the provision of runner bricks and central bricks, additional filling with sand and bricking with refractory mortar can be carried out. Various supplementary arrangements are placed along line 2 such as sand containers, stacks of brick, mortar containers, and so on. If so desired during preparation a base plate can rest above the fixed bed on the lifting device 10 of the transport car 9. When the base plate is prepared it can be picked up by an overhead crane and moved to the next station and be supplied with ingot molds and an ingate.

In the present example two transport lines are shown. In the example the cleaning and the preparation are separated from one another and anyone skilled in the art will easily see that the cleaning and turning of the base plates can be arranged so that the dust formed is confined and prevented from coming out into the rest of the working area, which is a definite advantage. The proposed transport method within the arrangement according to the invention has significant advantages. The fixed bed is not as vulnerable to blows and impacts because the base plates after preparation are handled gently and carefully. The operation of the transport cars and the turning device can, as is evident to anyone skilled in the art, be automated and programmed if so desired.

The following technical data is given for base plates which can be handled by the arrangement described above.

Base plates: size 3000 × 3000 × 250 mm
Weight: max. 17,000 kg
Complete base plate without ingot molds but including ingate and various scrap remnants after teeming weighs: ca. 30,000 kg
Cleaned base plate with new bricks and ingate and eight ingot molds weighs: ca. 50,000 kg In an embodiment of the arrangement according to the invention a movable assembly platform is arranged in the preparation station in front of the fixed bed so that several base plates can be worked on simultaneously, even after one or more of the base plates has been prepared.

As is evident to anyone skilled in the art the transport lines in the arrangement according to the invention can be constructed in another manner. Inter alia, an additional transport line can be arranged to the left of transport line 1 in FIG. 1 in line with, for example, transport line 2, as indicated by the chain-dotted lines in FIG. 1. Likewise, additional cleaning and turning stations 3 for base plates can be arranged in transport line 1, without going outside the scope of the invention.

What I claim is:

1. Apparatus for handling articles comprising at least two crossing transport lines, each said transport line including a fixed elevated bed for supporting articles, at least one transport car is each transport line and movable therealong across and to opposite sides of the other transport line, each transport car including an article support movable between raised and lowered positions respectively above and below the fixed bed of the corresponding transport line for lifting articles from and depositing articles on the latter fixed bed, and means for raising and lowering said article support whereby articles are transportable along the entire length of each transport line and transferable from one transport line to the other by lowering the support carried by the transport car in one transport line to deposit the article carried thereby on the bed adjacent the intersection of said lines and raising the support carried by the transport car in the other transport line to raise the article left by the transport car in the one transport line from the bed for transport along the other transport line by the transport car in said other transport line.

2. Apparatus according to claim 1 useful for handling and preparing base plates or casting molds wherein at least one transport line includes a knocking out station and a turning device for the base plates or casting molds, and a preparation station disposed in the other transport line.

3. Apparatus according to calim 1 wherein at least one of said fixed beds includes two rows of columns, the columns in each row being connected adjacent their upper ends by rails 4. Apparatus according to claim 1 wherein each said transport car comprises a wheeled chassis, a motor carried by said chassis for driving the car, each transport line including a track, said wheeled chassis being movable along said track.

5. Apparatus for handling articles comprising:

at least two transport lines intersecting one another, each said transport line including a fixed elevated bed for supporting articles, at least one transport car in each transport line and movable therealong, each transport car including a chassis and an article support movable between raised and lowered positions respectively above and below the fixed bed of the corresponding transport line for lifting articles from and depositing articles on the latter fixed bed, the fixed bed in at least one transport line being interrupted to form an opening adjacent the intersection of said transport lines, and means for raising and lowering said article support including a support member extending between said support and said chassis when said support is raised, whereby articles transportable along said transport lines are transferable from one line to the other by lowering the support carried by the transport car in one transport line to deposit the article carried thereby on the bed adjacent the intersection of said lines and raising the support carried by the transport car in the other transport line to raise the article left by the transport car in the one transport line from the bed for transport along the other transport line by the transport car in said other transport line with said support member passing through the interruption in the one transport line upon transfer of the article from the one transport line to the other transport line.

6. Apparatus according to claim 5 useful for handling and preparing base plates or casting molds wherein at least one transport line includes a knocking out station and a turning device for the base plates or casting molds, and a preparation station disposed in the other transport line.

7. Apparatus according to claim 5 wherein at least one of said fixed beds includes two rows of columns, the columns in each row being connected adjacent their upper ends by rails.

8. Apparatus according to claim 5 wherein each said transport car comprises a wheeled chassis, a motor carried by said chassis for driving the car, each transport line including a track, said wheeled chassis being movable along said track.

9. Apparatus according to claim 5 wherein at least one of said fixed beds includes two rows of columns, the columns in each row being connected adjacent their upper ends by rails, each said transport car comprising a wheeled chassis, a motor carried by said chassis for driving the car, each transport line including a track, said wheeled chassis being movable along said track.

* * * * *